US006588730B2

(12) United States Patent
Hughes

(10) Patent No.: US 6,588,730 B2
(45) Date of Patent: Jul. 8, 2003

(54) METHOD AND APPARATUS FOR USE IN POSITIONING HIGH-STRENGTH CABLES WITHIN A PRECAST, MOMENT RESISTING FRAME

(76) Inventor: Bill Hughes, 2476 N. Lake Ave., Altadena, CA (US) 91001

( * ) Notice: Subject to any disclaimer, the term of this patent is extended or adjusted under 35 U.S.C. 154(b) by 0 days.

(21) Appl. No.: 09/920,667

(22) Filed: Jul. 31, 2001

(65) Prior Publication Data

US 2003/0033716 A1 Feb. 20, 2003

(51) Int. Cl.[7] ..... B66F 3/00

(52) U.S. Cl. ..... 254/134.3 R; 254/134.3 FT; 29/897.34; 52/167.1; 52/223.8

(58) Field of Search ..... 29/897.34, 446; 254/452, 134.3 R, 134.3 FT, 134.5, 134.4; 264/228; 52/167.1, 223.14, 223.8, 721.1, 724.2, 600, 260, 259, 223.1, 223.4, 223.5, 223.9

(56) References Cited

U.S. PATENT DOCUMENTS 4,059,931 A * 11/1977 Mongan ..... 52/223.5
4,505,081 A * 3/1985 Dinis et al. ..... 52/223.14
4,959,940 A * 10/1990 Witschi ..... 52/583.1
5,027,864 A * 7/1991 Conti et al. ..... 138/177
5,675,943 A * 10/1997 Southworth ..... 52/167.1
6,003,842 A * 12/1999 Hug ..... 254/134.3 FT
6,257,808 B1 * 7/2001 Groot ..... 254/134.3 FT
6,327,825 B1 * 12/2001 Sanders et al. ..... 52/167.1
6,345,473 B1 * 2/2002 Fink et al. ..... 52/167.1

* cited by examiner

*Primary Examiner*—Gregory Vidovich
*Assistant Examiner*—T. Nguyen
(74) *Attorney, Agent, or Firm*—J. E. Brunton

(57) ABSTRACT

An apparatus for positioning high-strength cables within a precast, moment resisting frame made up of interconnected columns and beams in which the columns have an outside face provided with an opening and a cable receiving passageway in communication with the opening. The apparatus uniquely includes a cable routing subassembly for conveniently routing the cables from the interior of the moment resisting frame to the opening in the outside faces of the columns. The cable routing subassembly includes a curved tubular member that permits the cable to be inserted into an opening in the outside face of the column either from a first level within the structure that is substantially coplanar with the opening in the outside face of the column, or from a second level within the structure that is below the first level.

12 Claims, 11 Drawing Sheets

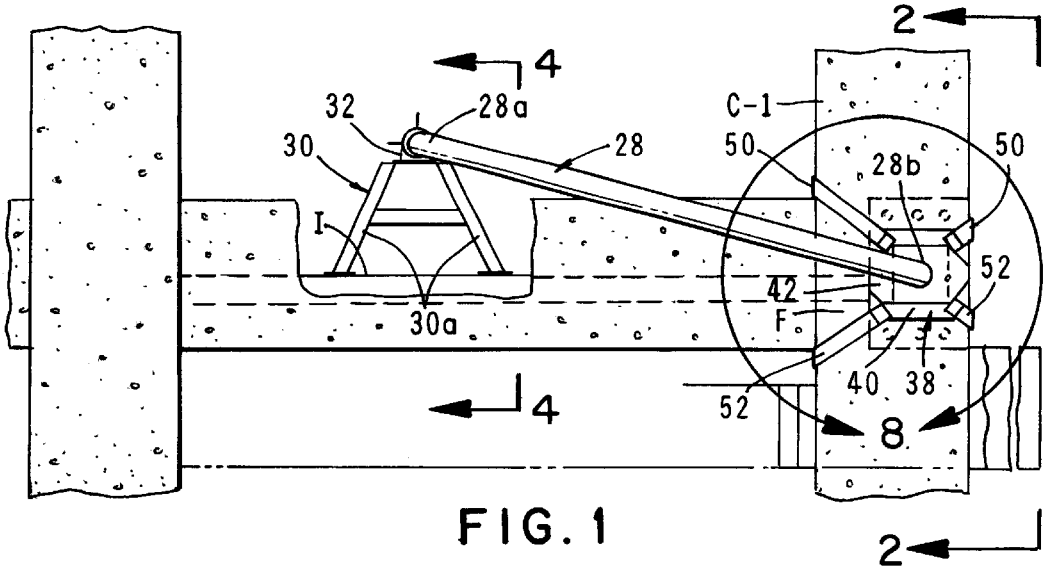
FIG. 1
FIG. 4
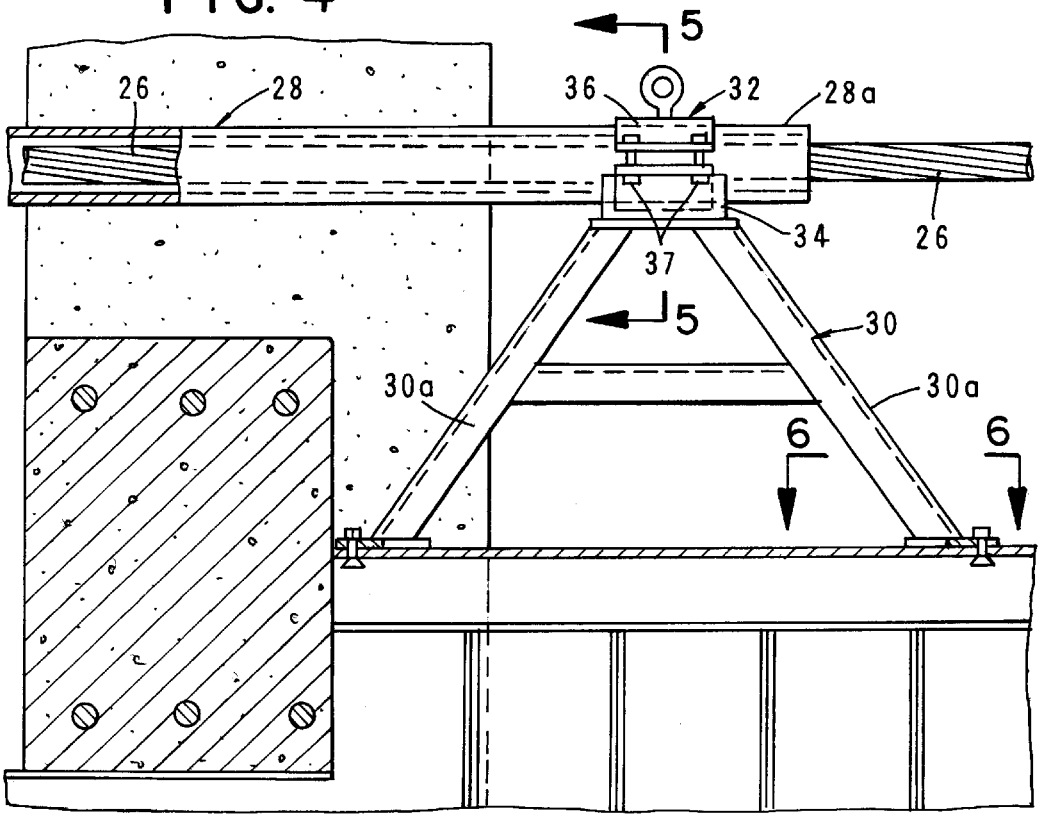

METHOD AND APPARATUS FOR USE IN POSITIONING HIGH-STRENGTH CABLES WITHIN A PRECAST, MOMENT RESISTING FRAME

BACKGROUND OF THE INVENTION

1. Field of the Invention

The present invention relates generally to a method and apparatus for use in the construction of precast, moment resisting frames of buildings. More particularly the invention concerns a method and apparatus for use in positioning high-strength cables within a precast, moment resisting frame made up of columns and beams that are interconnected by the high-strength cables.

2. Discussion of the Prior Art

In recent years great strides have been made in the design of high-rise buildings that resist lateral forces as well as vertical or gravity forces. One of the most successful prior art moment resisting frame designs is the design developed by the assignee of the present invention, namely Charles Pankow Builders, Ltd. This novel design includes moment resisting frames made up of columns and beams that are tied together in the horizontal direction by high-strength cables. These cables are entrained through a passageway located in the center of the beam so as to pass through the columns at the same elevation as the beam. In these structures, after the beam and column components are erected, the cables are entrained through the passageways and stretched or tensioned.

In the aforementioned types of prior art structures, tension within the stressed cables is typically transferred to the columns through wedge type anchors. The anchor imposes a clamping force on the columns transferring it through the interface between the columns and beam. This creates a compressive force through the moment resisting frame.

In the past, the installation of the cables in low-rise buildings was typically accomplished from outside of the building using lifts for access. However, for high-rise buildings, as for example buildings having over five or six floors, lift equipment is no longer capable of effectively providing this access. Nevertheless, in buildings where the frames terminate as the end of the side of the building, the cables must also be inserted from a point outside the buildings floor area. Additionally, high-rise buildings constructed in a regular floor-to-floor sequence have a need for routine cable installation techniques that accommodate the limited space availability inherent in such construction. To satisfy these needs, the apparatus of the present invention was developed. As will be better understood from the discussion that follows, this novel apparatus and the method associated with its use provide for the expeditious installation of the cables into the exterior spaces of the columns from inside rather than outside of the building.

SUMMARY OF THE INVENTION

It is an object of the present invention to provide an apparatus for positioning high-strength cables within a precast, moment resisting frame made up of interconnected columns and beams in which the columns have an outside face provided with an opening and a cable receiving passageway in communication with the opening. More particularly, is an object of the invention to provide a novel cable routing means for conveniently routing the cables from the interior of the moment resisting frame to the opening in the outside faces of the columns.

Another object of the invention is to provide an apparatus of the aforementioned character in which the cable routing means includes a curved tubular member that permits the cable to be inserted into an opening in the outside face of the column either from a first level within the structure that is substantially coplanar with the opening in the outside face of the column, or from a second level within the structure that is below the first level.

Another object of the invention is to provide an apparatus of the character described in the preceding paragraphs, which further comprises a locating plate that can be connected to the column so that an opening provided in the locating plate can be axially aligned with the opening and so that the distal end of the curved tubular member can be inserted into the opening.

Another object of the invention to provide an apparatus as described in the immediately preceding paragraph that further comprises a supporting stand that includes an upper portion adapted to support the proximal end of the curved tubular member.

Another object of the invention is to provide an apparatus of the class described that is of a simple construction, is easy use and is inexpensive manufacture.

Another object of the invention is to provide a method for conveniently inserting the high-strength cables into the opening in the outside faces of the columns from the interior, rather than the exterior of the moment resisting frame.

These and other objects of the invention can be achieved by the method and apparatus described in greater detail in the paragraphs would follow.

BRIEF DESCRIPTION OF THE DRAWINGS

FIG. 1 is a fragmentary, side elevational view of one form of the cable routing means of the invention for routing a high-strength cable from the interior of the moment resisting frame to an opening in the outside face of one of the columns of the frame.

FIG. 4 is a greatly enlarged, cross-sectional view taken along lines 4—4 of FIG. 1.

DISCUSSION OF THE INVENTION

Figure 1A:
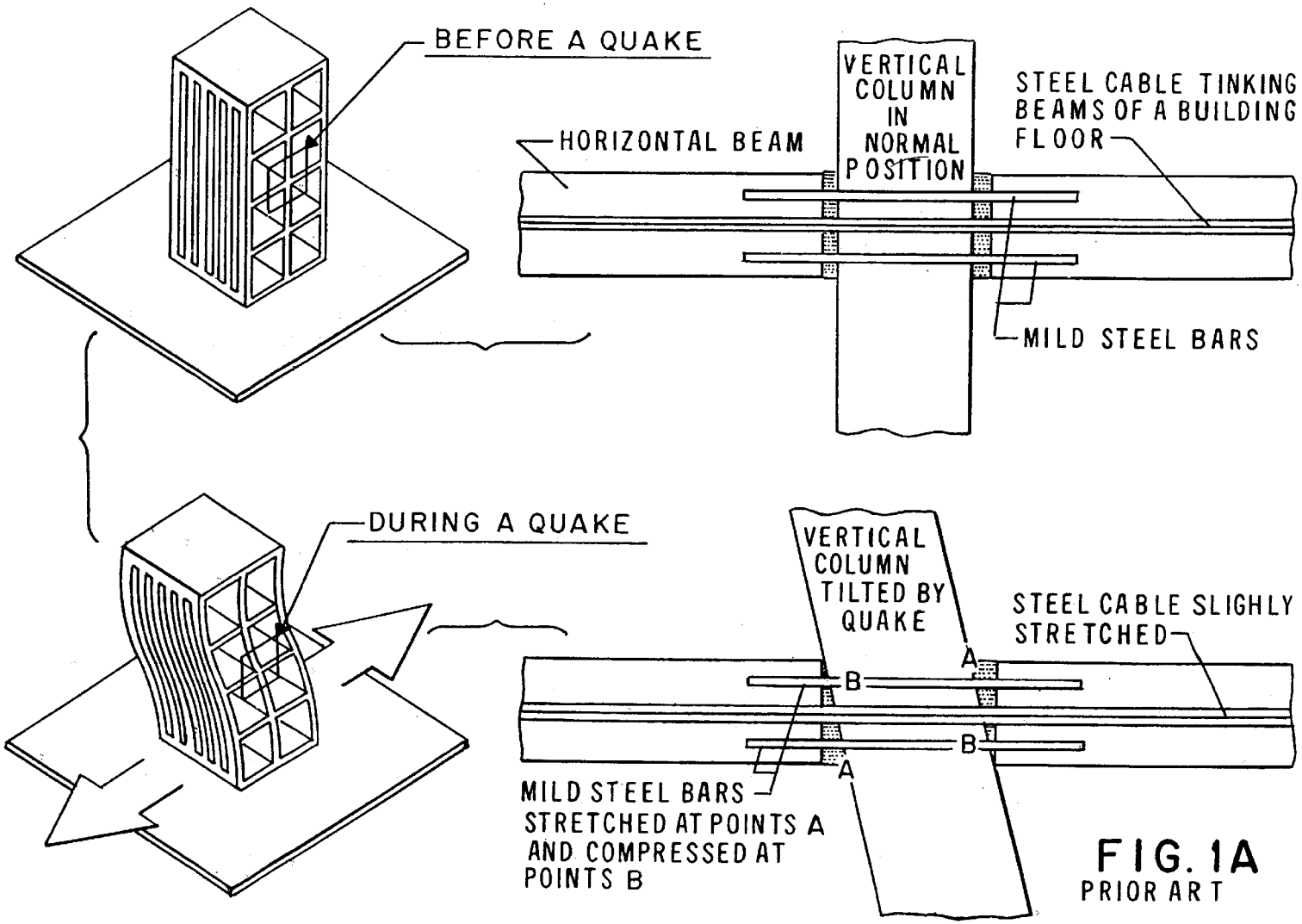
FIG. 1A PRIOR ART
FIG. 1A is a generally diagrammatic view of a prior art, pre-cast, moment-resisting frame-type construction with which the apparatus of the present invention is used.
Figure 2A:
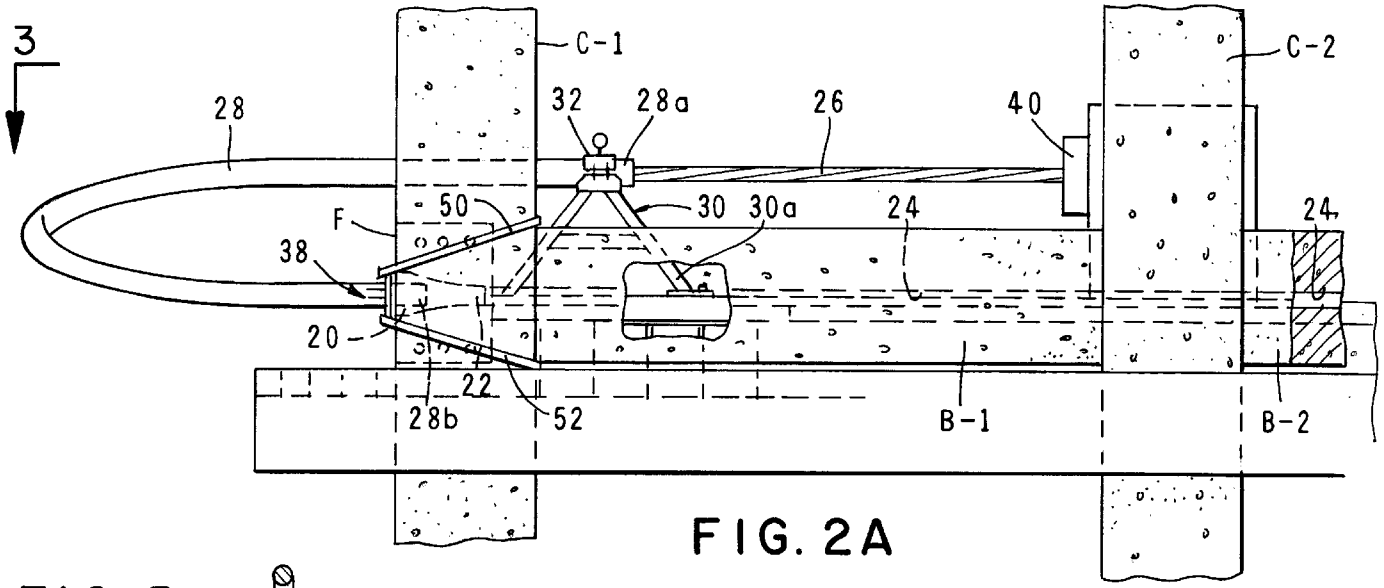
FIGS. 2A and 2B when considered together comprise a view taken along lines 2—2 of FIG. 1.

Referring to the drawings and particularly to FIG. 1, one form of the prior art building construction with which the apparatus of the present invention is usable is there illustrated. This novel building design comprises pre-cast, moment-resisting frames made up of columns and beams that are tied together in a horizontal direction by high-strength cables that are entrained through a passageway located in the center of the beams in the manner shown in FIG. 1. Typically, the passageway is located in the center of the beam so as to pass through the columns at the same elevation as the beams in the manner illustrated in the upper right-hand portion of FIG. 1. After the beam and column elements are erected in the manner shown in the upper left-hand corner of FIG. 1, the cables are installed in the ductwork and appropriately tensioned. The tensioned cables are clamped at the base of the columns resulting in the horizontal force that securely ties the columns and beams together.

Figure 3A:
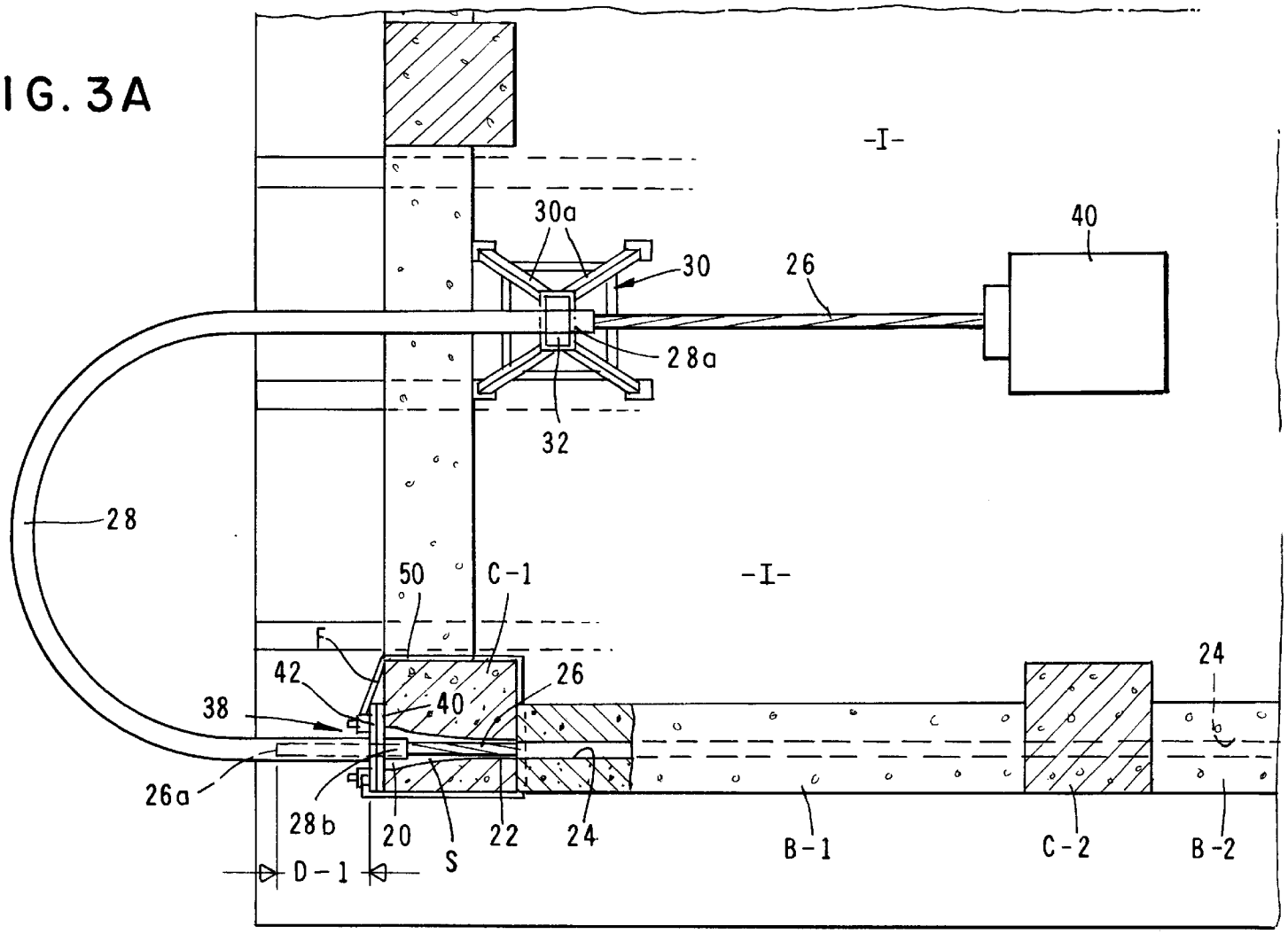
FIGS. 3A and 3B when considered together comprise a view taken along lines 3—3 of FIGS. 2A and 2B.
Figure 3B:
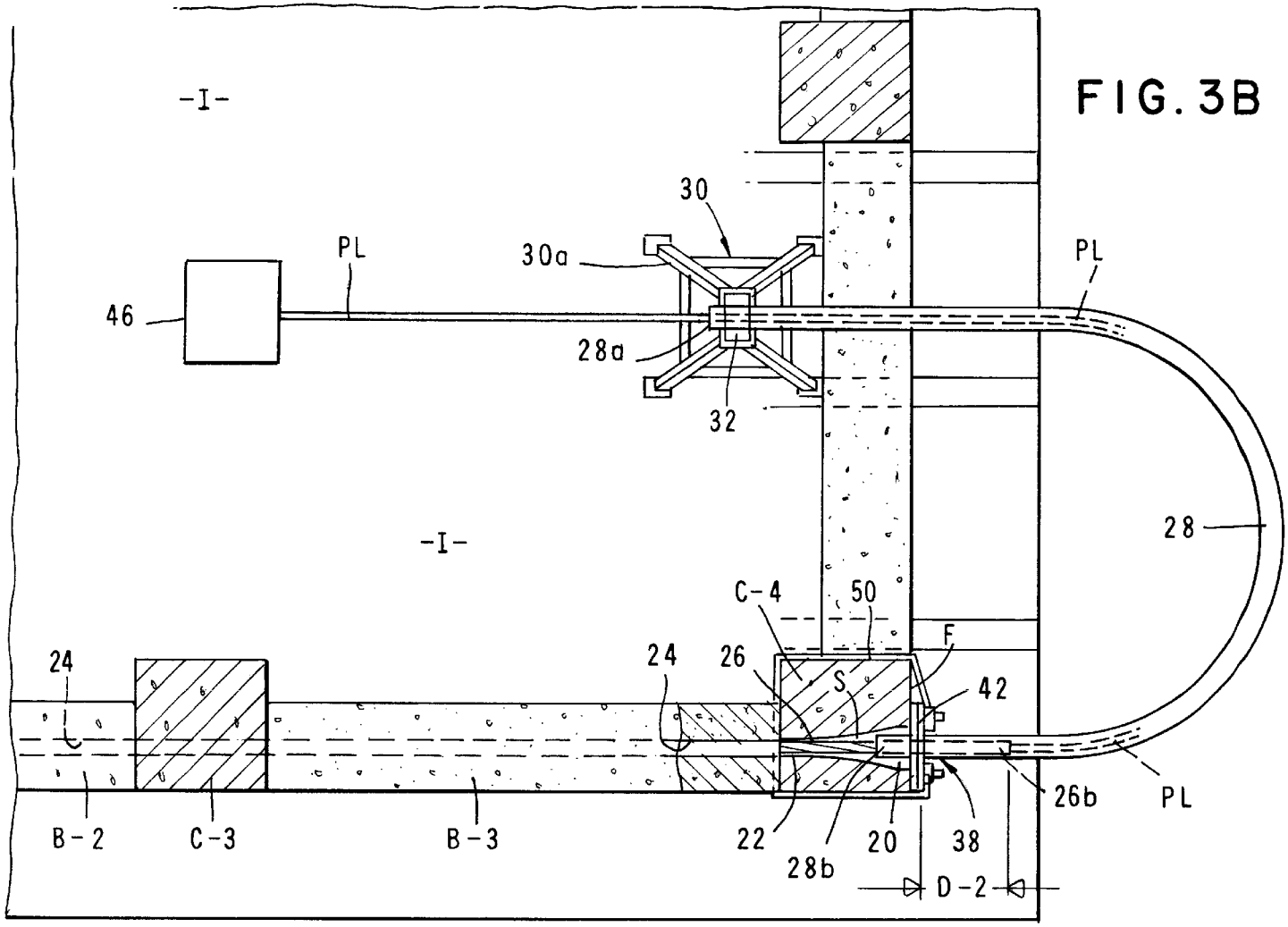

As previously mentioned, a particular object of the present invention is to provide a novel, easy-to-use apparatus for conveniently routing the cables from the interior of the moment resisting frame to the openings in the outside faces of the columns. Referring particularly to FIGS. 1, 3A and 3B, one form of the apparatus of the invention is there shown positioned for use in connection with a precast, moment resisting frame made up of interconnected columns C-1, C-2, C-3 and C-4 and beams B-1, B-2 and B-3. Each of the columns C-1 and C-4 has an outside face F provided with an opening 20 and a cable-receiving passageway 22 in communication with the opening. Similarly, each of the beams has a cable-receiving passageway 24 in communication with the cable-receiving passageway of the adjacent column.

In the present form of the invention, the cable routing apparatus comprises uniquely configured cable routing means for routing the cable 26 from the interior "I" of the moment resisting frame to the opening in the outside face "F" of the column which, as shown in FIG. 3A, is located exteriorly of the moment resisting frame. This novel cable routing means here comprises a curved tubular member 28 having a first end 28*a* disposed within the interior of the frame and a second end 28*b* disposed in communication with an opening 20 in a selected one or the columns as, for example column C-1.

Figure 6:
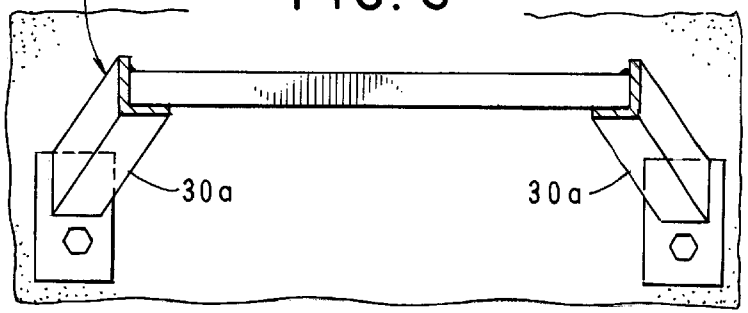
FIG. 6 is a cross-sectional view taken along lines 6—6 of FIG. 4.
Figure 5:
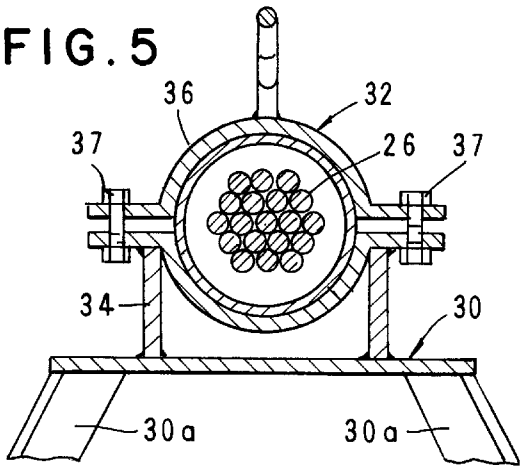
FIG. 5 is a greatly enlarged cross-sectional view taken along lines 5—5 of FIG. 4.
Figures 2B, 7:
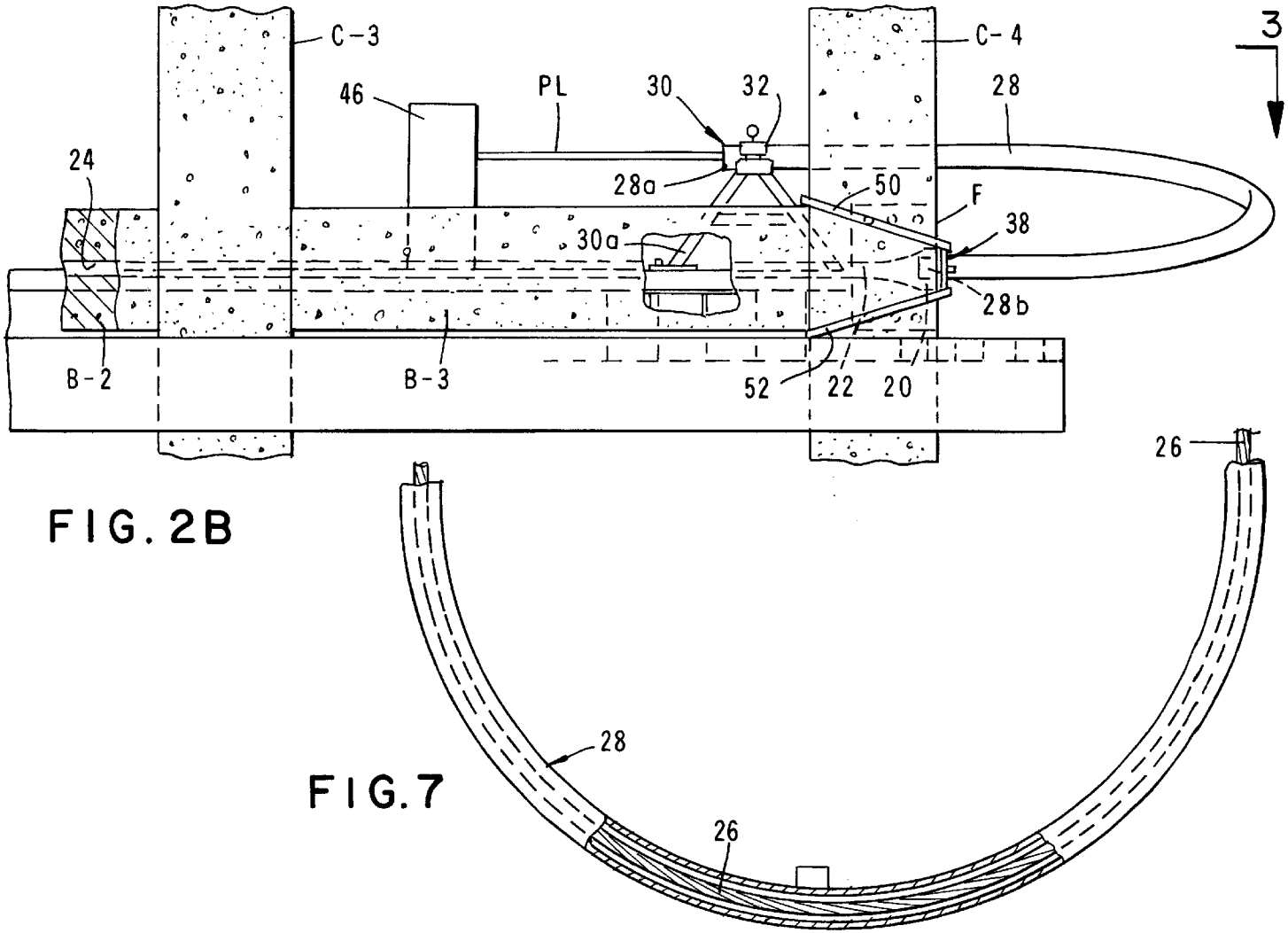
FIG. 7 is an enlarged view of a portion of the cable routing tube of the apparatus of the invention, partly broken away to show internal construction.

The apparatus of the present form of the invention further includes a supporting stand 30 that is disposed within the moment resisting frame and includes upper portion 32 for supporting first end 28*a* of tubular member 28. As best seen in FIG. 4, upper portion 32 of supporting stand 30 comprises a clamping means for releasably clamping first end 28*a* of top tubular member 28. This clamping means here includes a base portion 34 that is connected to the slab (FIG. 6). Base portion 34 is also interconnected with legs 30*a* of stand 30 and an upper clamping portion 36 that is releasably connected to base portion 34 by plurality of threaded fasteners 37 (FIG. 5). With this construction, by loosening threaded fasteners 37 clamping portion 36 can be separated from base 34 to permit the insertion of the end 28*a* curved tubular member 28. By tightening down on fasteners 37, end 28*a* of curved tubular member 28 can be fixedly secured to the upper portion of the stand.

Figure 8:
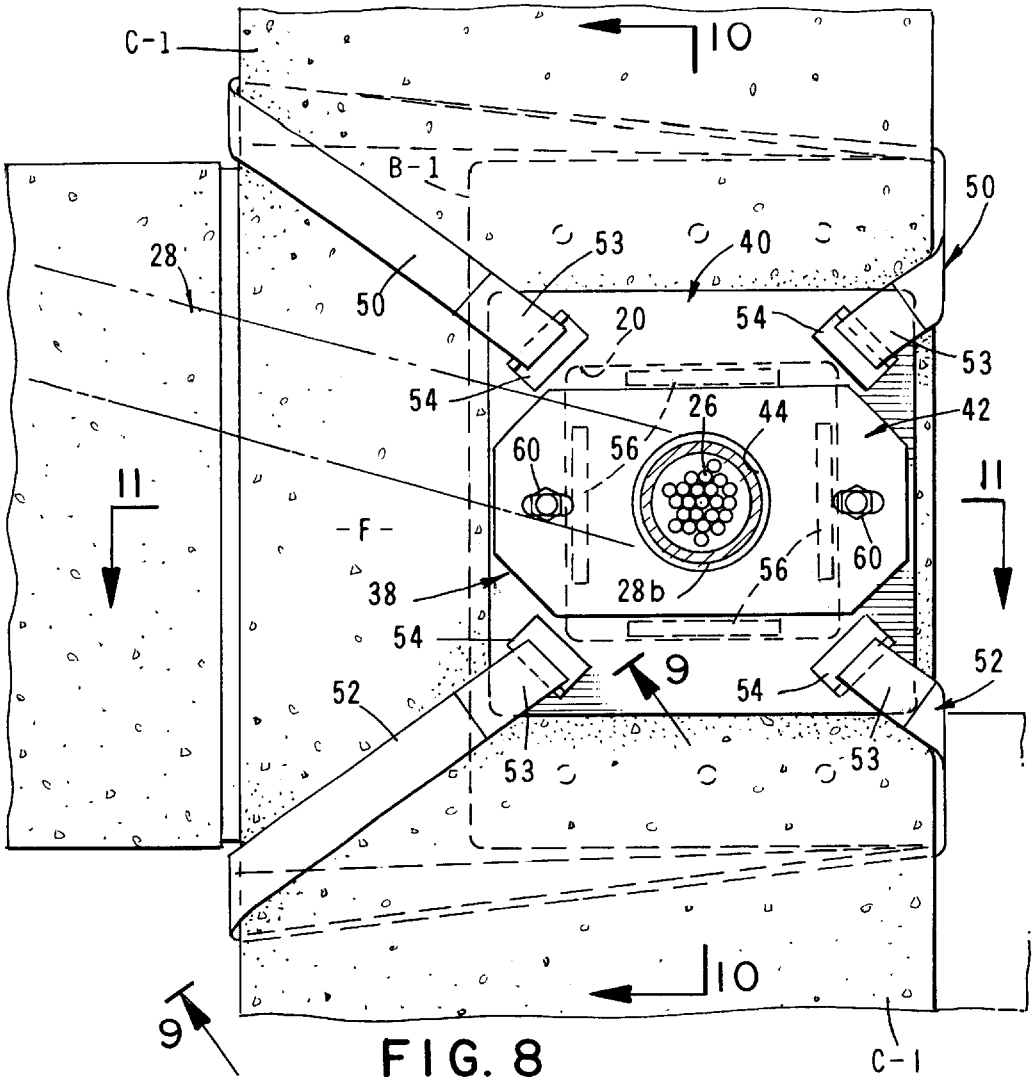
FIG. 8 is a greatly enlarged view of the area designated in FIG. 1 by the numeral 8.
Figure 9:
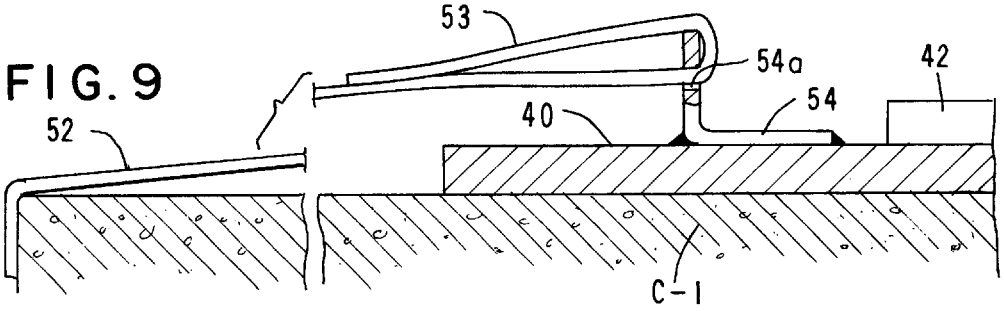
FIG. 9 is a greatly enlarged cross-sectional view taken along lines 9—9 FIG. 8.
Figure 10:
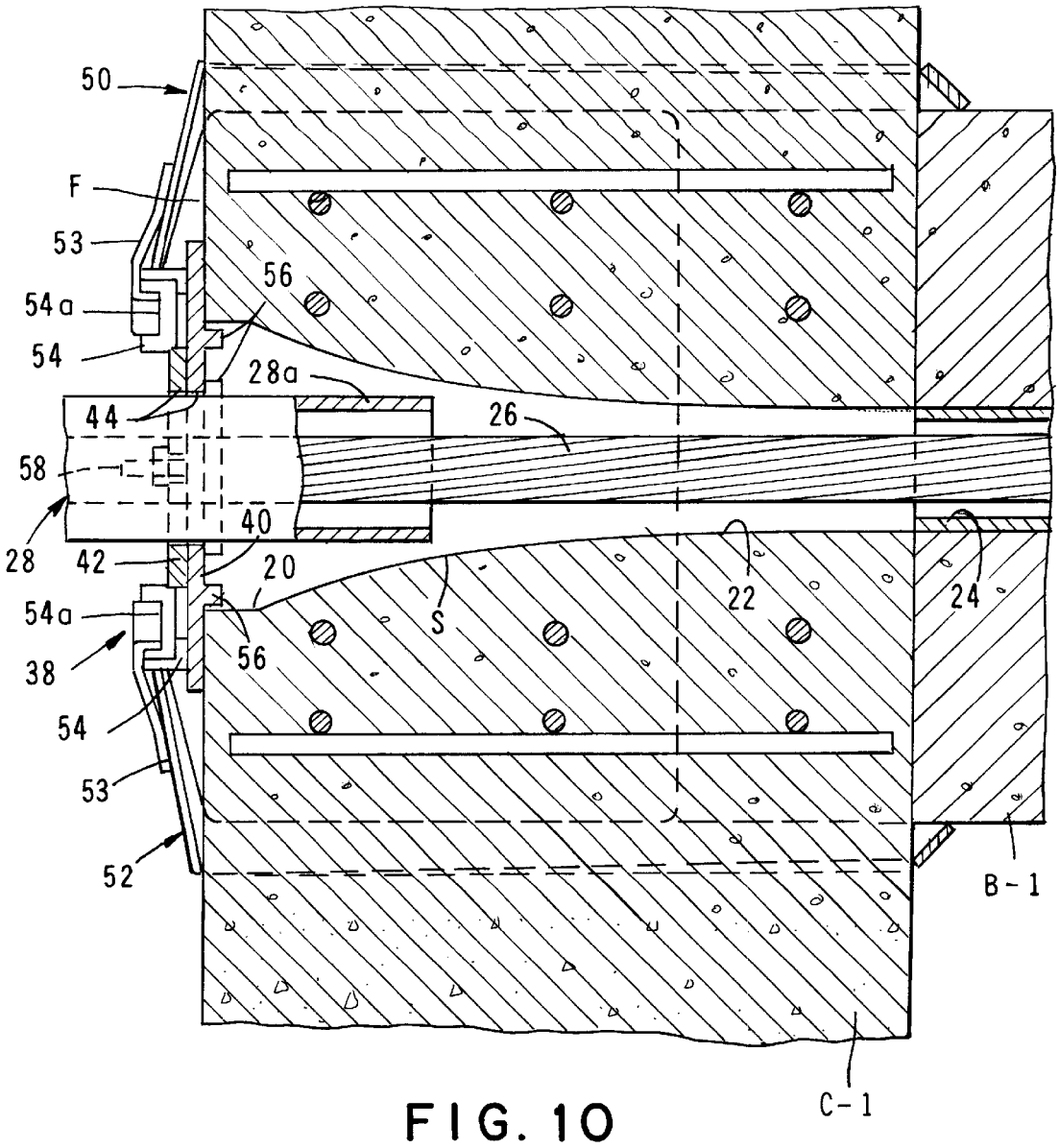
FIG. 10 is a cross-sectional view taken along lines 10—10 of FIG. 8.
Figure 11:
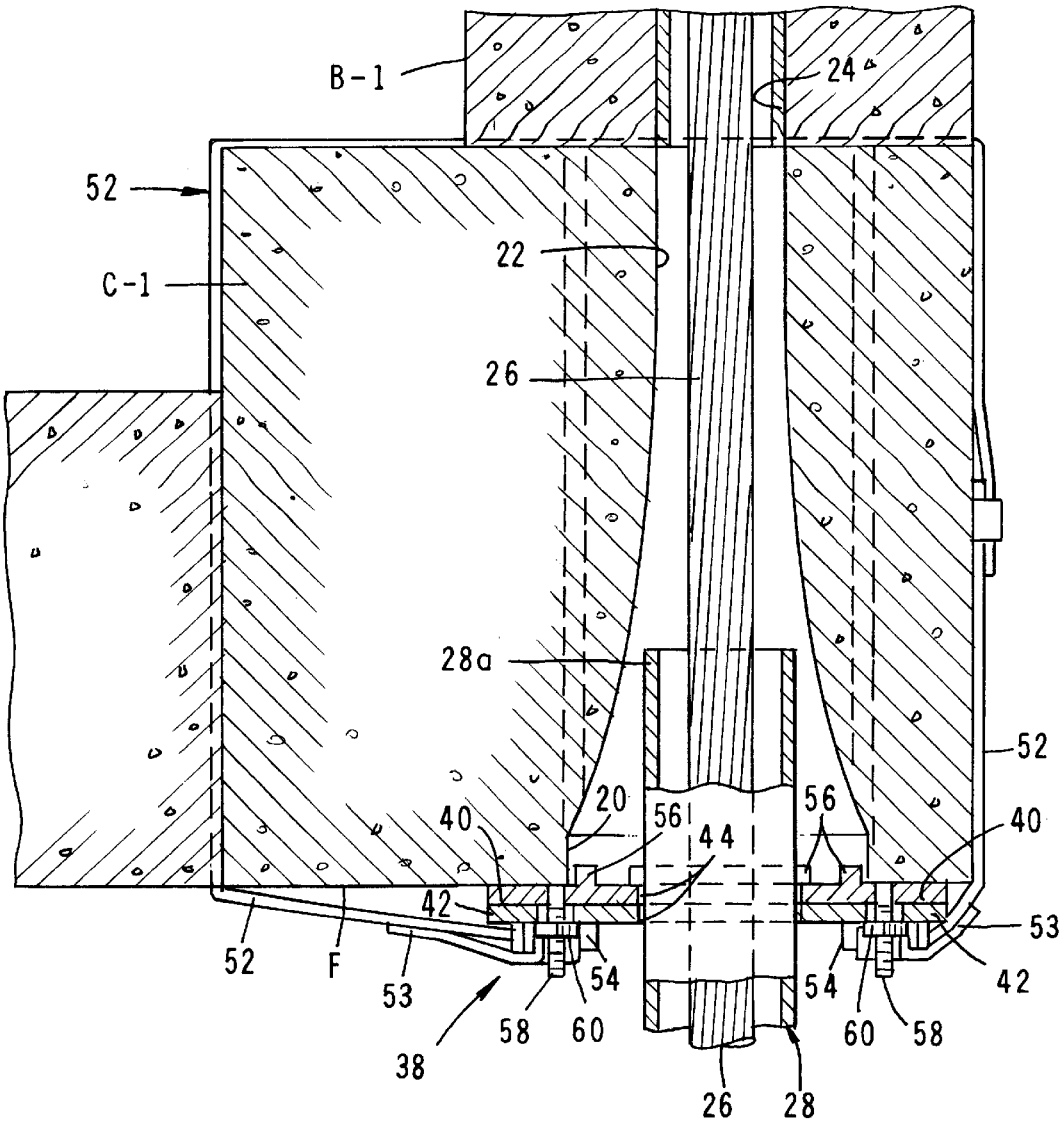
FIG. 11 is a cross-sectional view taken along lines and 11—11 of FIG. 8.
Figures 12, 13:
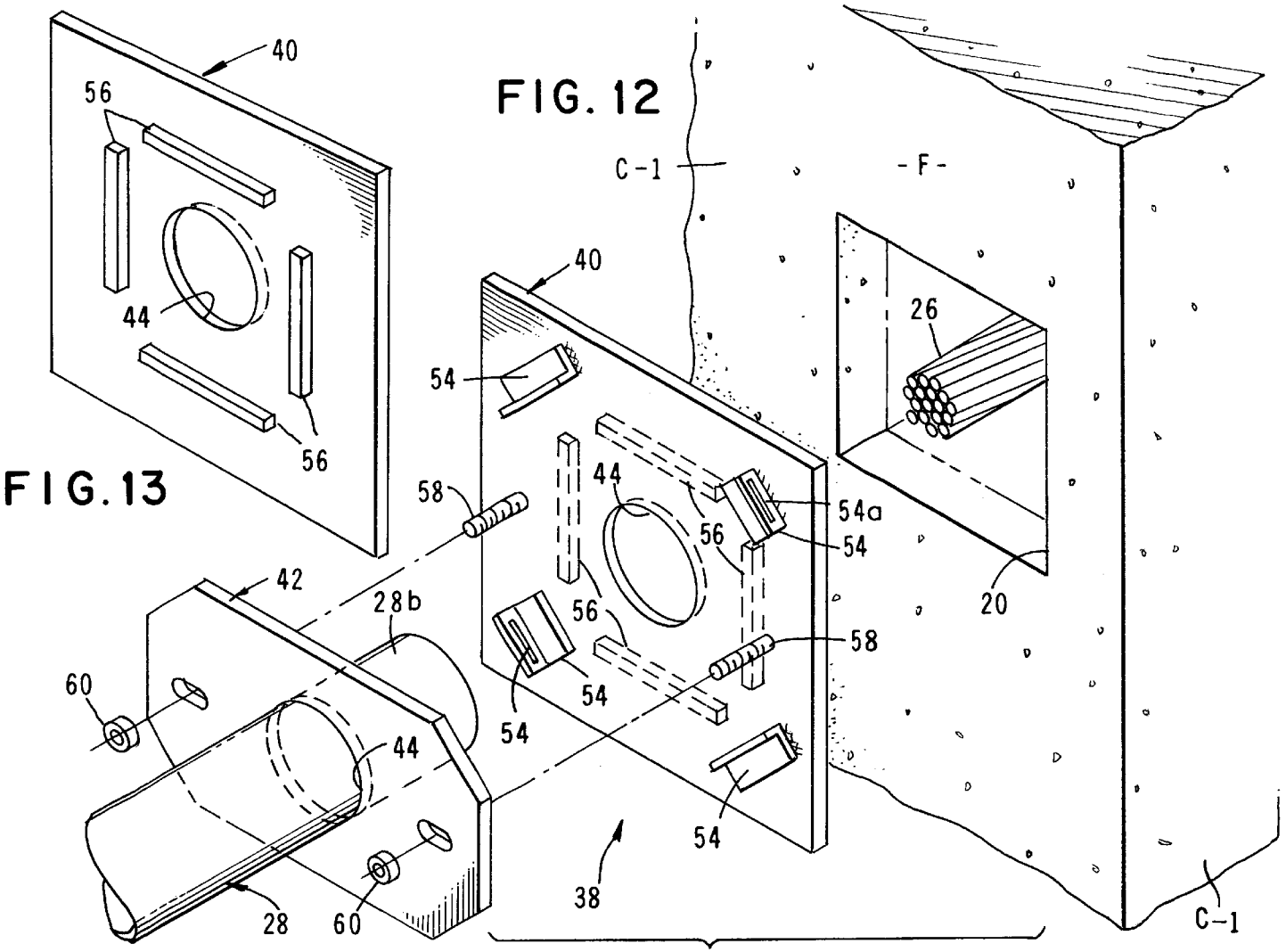
FIG. 12 is a generally prospective, exploded view of one form of locating plate assembly of the apparatus of the invention.
FIG. 13 is a generally perspective rear view of the inner locating plate of the locating plate assembly shown in FIG. 12.

The apparatus of the invention also includes a locating plate assembly 38 that is interconnected with each of the columns C-1 and C-4 in the manner shown in FIGS. 3A, 3B and 8. As best seen my referring to FIGS. 8, 10, 11 and 12, locating plate assembly 38 comprises a first or inner locating plate 40 and a second or outer locating plate 42 (FIG. 12). Each of the plates 40 and 42 is provided with an opening 44 that can be aligned with openings 20 formed in the outside surfaces of the columns. Openings 44 are sized so as to closely receive ends 28*b* of the tubular members 28 when the tubular members are in the operational position shown in FIGS. 3A and 3B. Plate 42 is secured to a selected column by strap means that here comprise upper and lower straps 50 and 52 respectively that are connected to the locating plate and circumscribe the column in the manner shown in FIG. 8. More specifically, each of the straps 50 and 52 has an end portion 53 that is received within an aperture 54*a* formed in one of four angle members 54 that are affixed proximate the corners of plate 40 (see FIGS. 9 and 13). When the straps are secured about the column, and tightened in the manner indicated in FIG. 8, the plate assembly will be securely held in coaxial alignment with the passageways 22 formed in the columns C-1 and C-4. As shown in FIG. 13, plate 42 is provided with four circumferentially spaced locating elements 56 that extend outwardly from the back of the plate and, as shown in figure, are closely received within opening 20 formed in column C-1 to assist in centering the plate. After end 28*b* of tubular member 28 is inserted into opening 44 in plate 42, plate 42 can be interconnected with plate 40 by means of threaded studs 58 and locking nuts 60 (FIGS. 11 and 13). In this way plate 44 and end portion 28*b* can be precisely centered with respect to opening 20.

Figure 14:
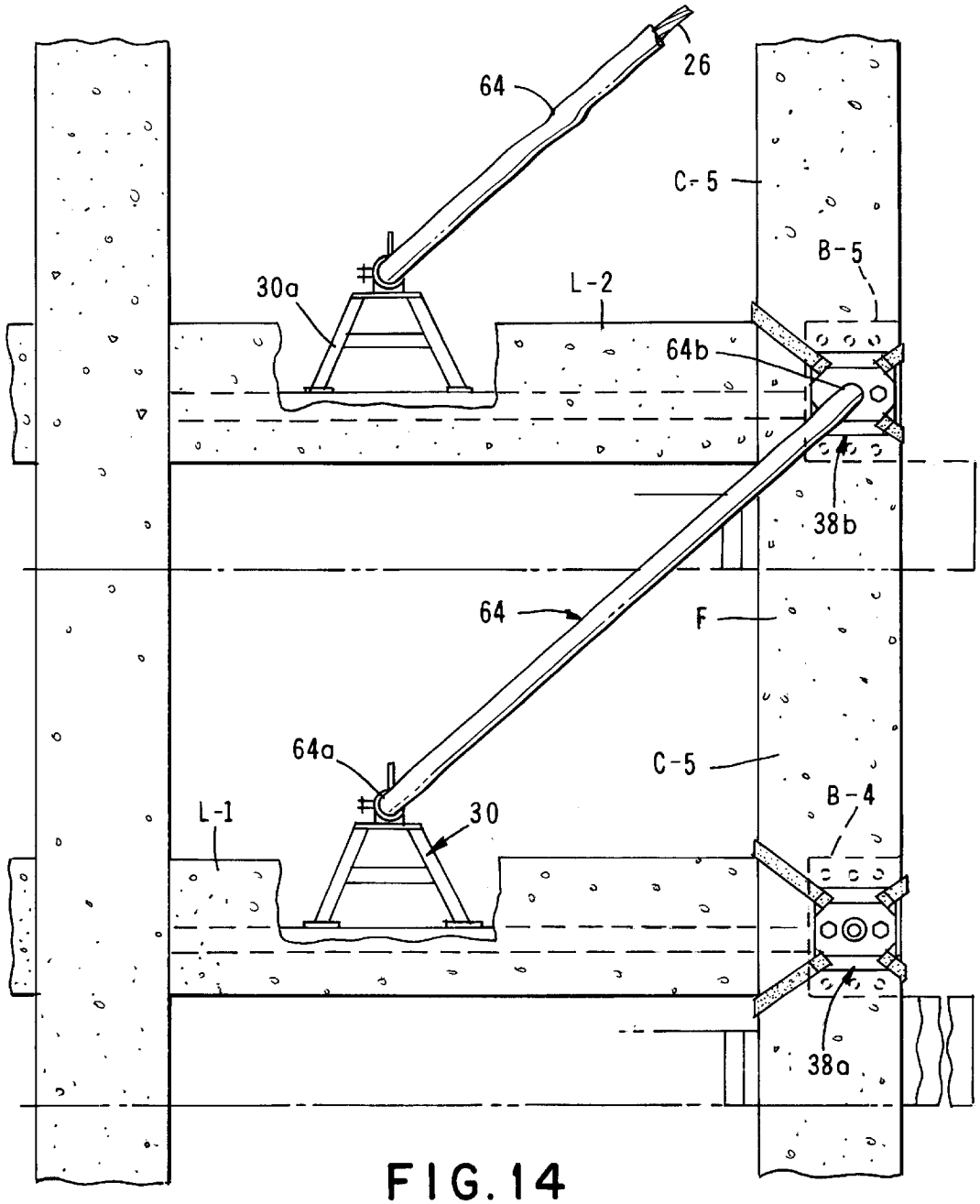
FIG. 14 is a fragmentary side elevational view similar to FIG. 1, but showing an alternate form of the apparatus of the invention for routing a cable from a first level within a structure to an opening in the outside face of a column located at a second level of the structure.

Referring next to FIG. 14 an alternate form of the apparatus of the invention is there shown positioned for use in connection with a precast, moment resisting frame made up of a column C-5 and first and second beams B-4 and B-5 connected to the column, the first beam being disposed at a first level L-1 and the second beam being disposed at a second higher level L-2. As in the earlier described building structure, column C-5 has an outside face provided with vertically spaced apart first and second openings and first and second cable receiving passageway in communication with the first and second openings. Similarly, beams B-4 and B-5 each have cable-receiving passageways in communication with the cable-receiving passageway of the column with which the beam abuts.

In this latest embodiment of the invention, the apparatus uniquely comprises cable routing means for routing the cable from the interior of the moment resisting frame at the lower level of the structure L-1 to a location proximate the next floor of the structure or upper level L-2. The cable routing means of this latest embodiment of the invention is similar to that previously described and like numbers are here used to identify like components. As illustrated in FIG. 14, the routing means here comprises a first locating plate assembly 38*a* that is interconnected with the column C-5 at the lower level L-1 and in alignment with beam B-4 and a second locating plate assembly 38*b* that is interconnected with the column C-5 at the upper level L-2 and in alignment with beam B-5. First and second locating plate assemblies 38*a* and 38*b* are identical in construction and operation to locating plate assembly 38.

Also forming a part of the routing means of this latest embodiment is a curved tubular member 64 having a first end 64*a* disposed within the interior of the frame at the lower level L-1 and a second end 64*b* that is connected to locating plate assembly 38*b*. As before, the routing means also includes a supporting stand 30 that is disposed within the moment resisting frame at the lower level L-1. Supporting stand 30 is identical in construction and operation to the stand previously described and includes an upper portion for supporting first end 64*a* of tubular member 64.

It is apparent that with the construction described in the preceding paragraph, tubular member 28 could be used with stand 30 to feed cable into beam B-4 via plate assembly 38*a*. It is also apparent that tubular member 64 could be used in connection with stand 30*a* that is positioned at the second level of the structure to feed cable into a beam located at the next adjacent upper level of the structure.

In using the apparatus of the invention, the curved tubular members 28 are installed within the structure in the manner indicated in FIGS. 3A and 3B. More particularly, in installing the apparatus end 28*b* of the tubular member shown in FIG. 3A is first inserted into plates 40 and 42. This done, end 28*a* of the tubular member is mounted within stand 30 in the manner previously described. Following installation of tube 28 in the manner shown in FIG. 3A, the tube 28 shown in FIG. 3B is similarly installed. More particularly, end 28*b* of this tubular member is inserted into plates 40 and 42 that are affixed to column C4. This done, end 28*a* is clamped within stand 30 as shown in FIG. 3B and as previously described. With the tubular members securely in position, an elongated, the relatively stiff pull line PL of a cable-pulling device (FIG. 3B) is inserted into end 28*a* of tubular member 28 as this member appears in FIG. 3A. The pull line is forced through tubular member 28 of FIG. 3A, through the passageway 22 of column C1, through the passageway 24 in beam B1, through the passageway formed in column C2, through the passageway 24 formed in B2, through the passageway formed in column C3, through the passageway 24 formed in beam B4, and finally into passageway 20 of column C4. The pull line will then enter tubular member 28 as mounted in the manner shown in FIG. 3B and will be forced outwardly of the tubular member through end 28*a* toward the interior "I" of the structure.

With the pull line extending through the assemblage in the manner described in the preceding paragraph and with a predetermined length of the cable 26 appropriately coiled within the interior of the structure shown in FIG. 3A, the end of the pull line PL is interconnected with the end of the predetermined length of cable. Then by exerting a pulling force on the pull line from the interior of the structure as shown in FIG. 3B, the cable can be pulled through tubular member 28 as shown in FIG. 3A, through column C1, through beam B1, through column C2, through beam B2, through column C3, through beam B3, through column C4, and through the tubular member shown in FIG. 3B. In the practice of one form of the invention, after the pull line has been inserted through the assemblage, a cable wheel assembly or like device generally designated in FIG. 3A by the numeral 40 can be used to assist in feeding the cable 26 through the tubular members and through the structure to a pre-determined point where end 26*a* of the cable extends from the plate assemblage affixed to column C-1 by a distance D-1. When end 26*a* of the cable, that is the end of the cable coiled in the interior of the structure shown in FIG. 3A, reaches the position shown in figure 3A, tubular member 28, as shown in FIG. 3A, is removed from the structure by loosening the clamping means 32 provided on stand 30 and by removing end 28*b* from the plate assembly made up of plates 40 and 42 that are affixed to column C1 in the manner previously described. This done, a wedging member of a character well known to those skilled in the art is connected to end 26*a* of the cable.

After the cable has been pulled through column C4 by the pull line, the end of the cable, indicated in FIG. 3B as 26*b*, will extend outwardly from the plate assemblage affixed to column C4 by a distance D-2 that is sufficient to enable a cable tensioning apparatus to be attached to the cable. With the cable end extending through column C4 in the manner indicated in FIG. 3B, and prior to connecting the cable tensioning device, the tubular member 28 shown in FIG. 3B can be removed from the structure by releasing clamping means 32 and by retracting end 28*a* of the tubular member from the plate assemblage that is affixed to column C4. Once the tubular member 28 has been removed from the structure, tension can be exerted on cable 26 by grasping end 26*a* of the cable with an appropriate tensioning apparatus of a character well understood by those skilled in the art. As the cable is tensioned, the wedging member affixed to end 26*a* will wedge within the trumpet structure S in the manner previously described. Following appropriate tensioning of the cable, the cable can be suitably secured in position by a second wedging member that is connected to cable end 26*b* for wedging engagement with the trumpet 42 that is positioned within column C4.

During the step of pulling of the pull line through the two tubular members 28 and through the beams and columns shown in FIGS. 3A and 3B, a pulling apparatus generally designated by the numeral 46 in FIG. 3B can be used to assist in pulling the pull line through the assemblage. Various types of pulling apparatus 46 can be used that are of a character well understood by those skilled in the art.

After the cable has been suitably tensioned by the tensioning device, stand 30 along with the apparatus 40 and 46 can be moved to another location to accomplish a similar cable installation process from the interior of the structure.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. In combination with a precast, moment resisting frame having an interior and an exterior and including an interconnected column and beam, the column having an outside face located exteriorly of the moment resisting frame and being provided with an opening and a cable receiving passageway in communication with the opening and the beam having a cable receiving passageway in communication with the cable receiving passageway of the column, an apparatus comprising cable routing means for routing the cable from the interior of the moment resisting frame to the opening in the outside face of the column located exteriorly of the moment resisting frame, said routing means comprising a curved tubular member having a first end disposed within the interior of the moment resisting frame and a second end located exteriorly of the moment resisting frame and disposed in communication with the opening in the column.

2. The apparatus as defined in claim 1 further including a supporting stand disposed within the moment resisting frame, said supporting stand having an upper portion for supporting said first end of said tubular member.

3. The apparatus as defined in claim 1 further including a locating plate interconnected with the column, said locating plate having an opening therein aligned with the opening in the outside surface of the column, said second end of said tubular member being received within said opening in said locating plate.

4. The apparatus as defined in claim 3 further including strap means connected to the said locating plate for interconnecting said locating plate with the column.

5. In combination with a precast, moment resisting frame having an interior and an exterior and including an interconnected column and beam, the column having an outside face located exteriorly of the moment resisting frame and being provided with an opening and a cable receiving passageway in communication with the opening and the beam having a cable receiving passageway in communication with the cable receiving passageway of the column, an apparatus comprising:

(a) a locating plate assembly comprising a first and second locating plates, each said locating plate having an opening aligned the opening in the outside face of the column;

(b) means connected to the said locating plate for interconnecting said locating plate with the column; and (c) a curved tubular member having a first end disposed within the interior of the frame and a second end located exteriorly of the moment resisting frame and disposed in communication with the opening in the outside face of the column.

6. The apparatus as defined in claim 5, further including a supporting stand disposed within the moment resisting frame, said supporting stand having an upper portion for supporting said first end of said stand having an upper portion for supporting said first end of said tubular member.

7. The apparatus as defined in claim 5 in which said first plate includes a plurality of circumferentially spaced locating elements for centering said plate within the opening in the outside face of the column.

8. The apparatus as defined in claim 5 in which said means connected to the said locating plate comprises strap means, including upper and lower straps that circumscribe the column.

9. In combination with a precast, moment resisting frame having an interior and an exterior and including a column and first and second beams connected to the column, the first beam being disposed at a first level and the second beam being disposed at a second level, the column having an outside face disposed exteriorly of the moment resisting frame and being provided with vertically spaced apart first and second openings, a first cable receiving passageway in communication with the first opening and a second cable receiving passageway in communication with the second opening, the first beam having a cable receiving passageway in communication with the first cable receiving passageway of the column and the second beam having a cable receiving passageway in communication with the second cable receiving passageway of the column, an apparatus comprising cable routing means for routing the cable from the interior of the moment resisting frame to said second opening in the outside face of the column located exteriorly of the frame, said routing means comprising a curved tubular member having a first end disposed within the interior of the frame and a second end disposed exteriorly of the frame and in communication with said second opening in the column.

10. The apparatus as defined in claim 9 in which said routing means comprises a first curved tubular member having a first end disposed within the interior of the frame and the first level and a second end disposed in communication with said second opening in the column.

11. The apparatus as defined in claim 10 in which said routing means further comprises a locating plate interconnected with the column and having an opening therein aligned with the second opening in the outside surface of the column.

12. The apparatus as defined in claim 11 further including a supporting stand disposed within the moment resisting frame, said supporting stand having an upper portion for supporting said first end of said tubular member.

* * * * *